US008646303B2

(12) United States Patent
Welser et al.

(10) Patent No.: US 8,646,303 B2
(45) Date of Patent: Feb. 11, 2014

(54) PROCESS FOR PRODUCING A PROFILE FROM A FLAT METAL STRIP

(75) Inventors: Thomas Welser, Ybbsitz (AT); Kurt Aigner, Ybbsitz (AT); Harald Schachinger, Waidhofen/Ybbs (AT)

(73) Assignee: Welser Profile AG, Ybbsitz (AT)

( * ) Notice: Subject to any disclaimer, the term of this patent is extended or adjusted under 35 U.S.C. 154(b) by 589 days.

(21) Appl. No.: 12/739,879

(22) PCT Filed: Sep. 12, 2008

(86) PCT No.: PCT/EP2008/007571
§ 371 (c)(1),
(2), (4) Date: Aug. 16, 2010

(87) PCT Pub. No.: WO2009/052906
PCT Pub. Date: Apr. 30, 2009

(65) Prior Publication Data

US 2010/0319432 A1 Dec. 23, 2010

(30) Foreign Application Priority Data

Oct. 26, 2007 (DE) ..... 10 2007 051 354

(51) Int. Cl.
*B21B 23/00* (2006.01)

(52) U.S. Cl.
USPC ..... 72/366.2; 72/167; 72/179; 72/234; 492/1; 492/27; 492/28

(58) Field of Classification Search
USPC ..... 72/167, 179–182, 185, 186, 197, 234, 72/235, 240, 252.5, 365.2, 366.2, 379.6; 492/1, 27, 28, 30, 33
See application file for complete search history.

(56) References Cited

U.S. PATENT DOCUMENTS

| | | | | | |
|---|---|---|---|---|---|
| 2,471,490 | A | * | 5/1949 | Mercer | 72/178 |
| 3,209,432 | A | * | 10/1965 | Cape | 29/897.2 |
| 3,393,547 | A | * | 7/1968 | Kortan | 72/131 |
| 3,475,937 | A | * | 11/1969 | Lawler | 72/181 |
| 3,827,269 | A | * | 8/1974 | Hoagland et al. | 72/108 |
| 4,233,833 | A | * | 11/1980 | Balinski | 72/180 |
| 4,716,754 | A | * | 1/1988 | Youngs | 72/178 |
| 4,735,074 | A | * | 4/1988 | Saito et al. | 72/234 |
| 4,770,018 | A | * | 9/1988 | Bosl et al. | 72/177 |
| 4,876,837 | A | * | 10/1989 | Kelly et al. | 52/287.1 |

(Continued)

FOREIGN PATENT DOCUMENTS

| | | | |
|---|---|---|---|
| AT | 302785 | B1 | 10/1972 |
| DE | 1 452 646 | A1 | 3/1969 |

(Continued)

*Primary Examiner* — Dana Ross
*Assistant Examiner* — Leonel Vasquez
(74) *Attorney, Agent, or Firm* — Baker & Hostetler LLP

(57) ABSTRACT

A method for the manufacture of a profile having a cross-section of different thicknesses from a flat metal strip is provided. In this process, a roller pair produces at least one first recess on at least one side of the metal strip, the recess being widened by following roller pairs with incrementally enlarged recess width to form a region with a reduced material thickness. The aim of the invention is to improve the production process, in particular to avoid the formation of undulations during the production of the profile. For this purpose, the invention provides that regions of the flat metal strip which are arranged adjacent to the at least one recess are bent up before and/or during an engagement of a roller pair.

11 Claims, 4 Drawing Sheets

(56) References Cited

U.S. PATENT DOCUMENTS

| | | | | |
|---|---|---|---|---|
| 4,969,346 | A | 11/1990 | Bosl et al. | |
| 5,761,946 | A * | 6/1998 | Misera et al. | 72/181 |
| 5,890,389 | A * | 4/1999 | Ohba et al. | 72/234 |
| 8,047,041 | B2 * | 11/2011 | Hermann et al. | 72/226 |
| 8,485,012 | B2 * | 7/2013 | Hermann et al. | 72/177 |
| 2009/0205390 | A1 * | 8/2009 | Hermann et al. | 72/252.5 |

FOREIGN PATENT DOCUMENTS

| | | | | |
|---|---|---|---|---|
| DE | 2234604 | C3 | 1/1977 | |
| DE | 36 22 926 | A1 | 3/1987 | |
| DE | 10120063 | C2 | 3/2003 | |
| EP | 1101546 | A | 5/2001 | |
| EP | 1847334 | A2 | 10/2007 | |
| JP | 02169105 | A * | 6/1990 | B21B 1/08 |

* cited by examiner

PROCESS FOR PRODUCING A PROFILE FROM A FLAT METAL STRIP

CROSS-REFERENCE TO RELATED APPLICATIONS

This application is a National Stage of International Patent Application No. PCT/EP2008/007571, filed on Sep. 12, 2008, which claims priority to foreign Patent Application No. DE 10 2007 051 354.4, filed on Oct. 26, 2007, the disclosures of which are incorporated herein by reference in their entirety.

FIELD OF THE INVENTION

The invention relates to a method for manufacturing a profile with a cross-section of different thicknesses from a flat metal strip by means of roll-profiling. In this method a roller pair produces at least a first recess on at least one side of the metal strip, said recess being widened by following roller pairs with increasing recess width to form a region with reduced material thickness.

BACKGROUND OF THE INVENTION

A method of this nature is for example known from DE 36 22 926 A1. In the method described therein a flat metal sheet is passed through a rolling mill with a central working roller with a very large diameter and a plurality of second working rollers with a significantly smaller diameter, which are arranged on the external circumference of the first working roller. The second working rollers are arranged one behind the other and have one or more protrusions on their external circumference, wherein the width of these protrusions of the consecutively arranged second working rollers increases. In this way the flat metal sheet is reshaped such that it assumes a special cross-sectional shape with one or a plurality of longitudinal grooves or channels on one side.

It is known that during the manufacture of a metal sheet of this nature undulations can be formed in the metal sheet. This formation of undulations should be reduced through the combination of the first central working roller with a large diameter with the plurality of second working rollers with a significantly smaller diameter, which are arranged on the first central working roller. In addition, retaining plates can be provided, which are arranged between the second working rollers and press the metal sheet in this region onto the external circumference of the central working roller, so that the metal sheet in these regions does not bulge outwards.

SUMMARY OF THE INVENTION

The object of the present invention is to provide a method in which the formation of undulations during the manufacture of a profile from flat metal strip with different material thicknesses in the lateral direction of the metal strip is further reduced or avoided.

In this respect the invention provides that regions of the flat metal strip which are arranged adjacent to the at least one recess are bent up before and/or during an engagement of a roller pair.

In this context bending up is taken to mean that the regions of the flat metal strip arranged adjacent to the at least one recess are moved out of a plane spanned by the central part of the metal strip, so that they enclose an angle with this plane of the central part of the metal strip. The bending up of the appropriate regions can occur in both directions, i.e. when the metal strip in the method is moved horizontally, the appropriate regions can be positioned vertically upwards or downwards.

Due to the change in cross-section of the flat metal strip, the stiffness of the metal strip is increased and the metal strip with the bent-up regions then exhibits a greater section modulus, whereby the formation of undulations during shaping is reduced or prevented. In particular with wide metal strips, it is desirable that these bent-up regions are not situated too far from the at least one recess. The regions of the metal strip which are bent up do not however need to be arranged directly adjacent to the at least one recess.

If the regions of the flat metal strip arranged adjacent to the at least one recess are bent-up before and/or during the engagement of the first roller pair, the metal strip then attains the desired higher stiffness right at the start of the forming process.

In a preferred variant of the method, provision can be made that roller pairs engage in the metal strip in the bending region of the bent-up regions for producing the respective recess. By bending up the appropriate regions of the metal strip, a shaping process is initiated and the material of the metal strip in the bending region starts to flow, whereby the material displacement due to the engaging rollers during the formation or widening of the recess is facilitated.

It is furthermore advantageous if the regions of the metal strip are bent up in the direction of the side of the metal strip in which the at least one recess is provided. In this way the roller forming the recess can be used as a limit stop for bending up the appropriate regions of the metal strip, whereby the bending up is facilitated. In addition, easier formation of the recess is possible and the risk of crack formation in the region of the recess is reduced.

A particularly preferred variant of the method provides for the appropriate regions of the flat metal strip being bent up incrementally in a plurality of roller pairs until a maximum erection angle between a central part of the metal strip and the bent-up regions is achieved. In this way, the effect that the formation of a region with less material thickness is facilitated due to the simultaneous bending of the appropriate regions and the engaging of the rollers for the production or widening of the recess, can be obtained in a plurality of roller pairs.

Expediently, provision can also be made for the recess-widening roller of each roller pair to first engage the bent-up region or regions of the metal strip and to press them against the corresponding opposing roller of the roller pair before the recess is widened. Consequently, the first roller initially only engages the metal strip with part of its circumferential area, wherein only a lesser force is required.

The effect, namely that the simultaneous bending-up of the appropriate regions of the metal strip and the penetration of the first roller into the metal strip facilitates the sidewards material displacement, can also be used after attaining the maximum erection angle, if, after attaining the maximum erection angle, the bent-up regions of the flat metal strip are bent back in the direction of a plane passing through the central part of the metal strip before each further roller pair. With the following recess produced in the metal strip by a roller of the following roller pair the appropriate regions are pulled away slightly from this plane so that with the renewed bending-up of the appropriate regions before the next roller pair, the desired erection angle is again attained.

In a particularly preferred variant of the method provision can be made that the maximum erection angle between the bent-up regions of the metal strip and the central part of the metal strip is located in the range from 10° to 80°, preferably at 30°. Experiments have shown that this angular range is particularly suitable. In this range the effect is used that simultaneous bending-up of the appropriate regions and penetration of the rollers into the material of the metal strip for producing regions with less material thickness facilitates the sidewards movement of the material. Simultaneously, the profile in this angular range is not yet closed too far, so that the roller pairs of the roll-profiling system can easily engage the metal strip.

In a particularly simple variant of the method it can be provided that the edges of the flat metal strip are bent up. In this case the bent-up regions correspond to the edges. This is particularly advantageous with narrow metal strips.

A further positive effect can be achieved if the lateral edge of the region with less material thickness which is arranged closer to the central part of the metal strip, maintains a constant position. The material of the metal strip in the region with less material thickness is therefore only pushed outwards, so that in the central region of the metal strip no undesired collection of material can occur, which may possibly produce undulations or bending of the metal strip.

In another variant of the method it can be provided that the method comprises further production steps, such as punching or stamping. These production steps can also occur before the shaping of the flat metal strip to form the profile. In this way all the desired processing steps of the profile can be carried out in one system.

BRIEF DESCRIPTION OF THE DRAWINGS

In the following the invention is explained in more detail based on drawings. The following are shown.

DETAILED DESCRIPTION

Figure 1:
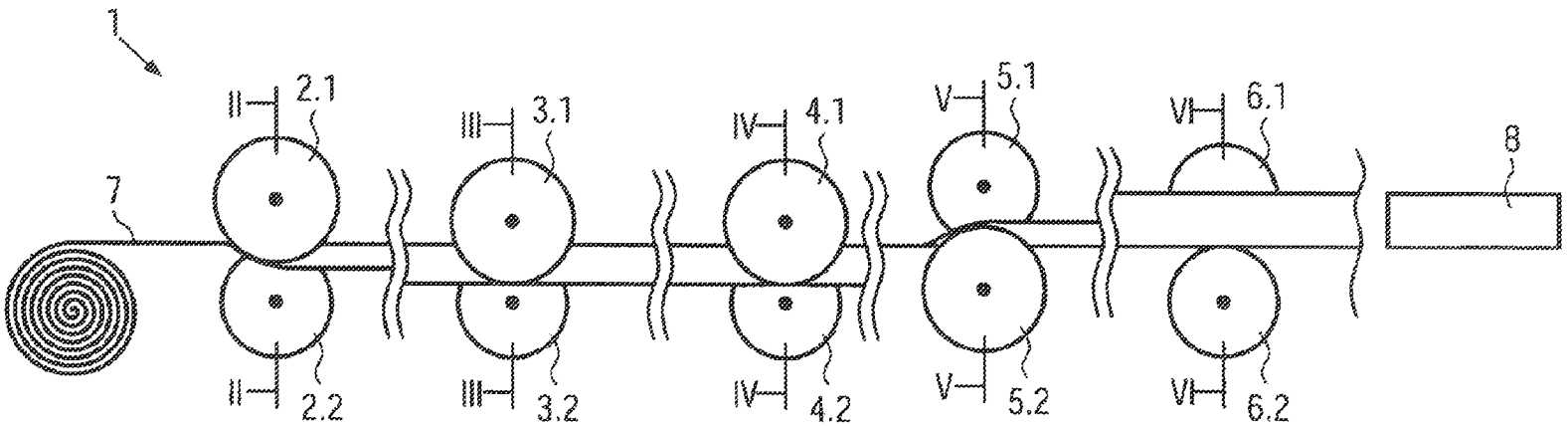
FIG. 1 a side view of a roll-profiling system for the manufacturing method according to the invention, FIG. 2 a section along the line II-II through a roller pair of the roll-profiling system of FIG. 1, FIG. 3 a section along the line III-III through a roller pair of the roll-profiling system of FIG. 1, FIG. 4 a section along the line IV-IV through a roller pair of the roll-profiling system of FIG. 1, FIG. 5 a section along the line V-V through a roller pair of the roll-profiling system of FIG. 1, FIG. 6 a section along the line VI-VI through a roller pair of the roll-profiling system of FIG. 1.

FIG. 1 illustrates a side view of a roll-profiling system 1 for the implementation of the manufacturing method according to the invention for a profile 8, which has a cross-section with regions of different material thickness or depth. The roll-profiling system 1 comprises a plurality of roller pairs 2.1, 2.2; 3.1, 3.2; 4.1, 4.2; 5.1, 5.2; 6.1, 6.2 arranged on roller stands (not illustrated). In FIG. 1 not all roller pairs of the roll-profiling system 1 are illustrated. As the case may be, one or a plurality of roller pairs have been left out between the illustrated roller pairs.

Flat metal strip 7, which is preferably rolled up to form a coil, is fed to the roll-profiling system 1. For the strip material steel, stainless steel, high strength steel, copper or aluminium and copper alloys or aluminium are used, for example. The flat metal strip 7 is shaped to form a profile 8 in the roll-profiling system 1. For this, steps are provided in the roll-profiling system 1 to reduce the material thickness of the flat metal strip 7 in regions running in the longitudinal direction of the metal strip 7 or of the profile 8, i.e. in the rolling direction. The finished profile 8 therefore has a cross-section with different thicknesses. It is already known to manufacture profiles of this nature. One problem with methods of this nature is that the material forced out of the regions with lower material thickness must not be displaced in the longitudinal direction, because otherwise undulations may form or the metal strip may bend up. In the roll-profiling system 1 a first roller pair 2.1, 2.2 is therefore provided, which is formed such that the edges 9.1, 9.2 of the metal strip 7 are bent up before and/or during the production of the first recess. The edge regions are bent up particularly with narrower metal strips. With wide metal strips it is advantageous, if regions, which are arranged adjacent to the recess or recesses and which can also be arranged centrally in the metal strip, are bent up. In the following the method for metal strips is described, in which the edges are bent up. The following description also applies analogously however to metal strips, for which the regions arranged adjacently to the recess or recesses do not correspond to the edges, but are instead arranged further towards the centre of the metal strip.

Figure 2:
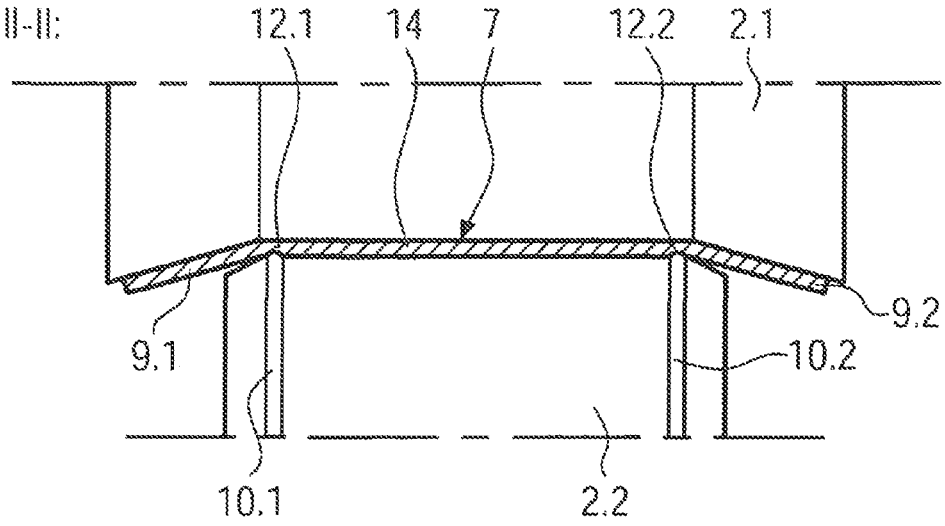

FIG. 2 illustrates a section through the roller pair 2.1, 2.2. This figure only illustrates one half of each of the rollers 2.1, 2.2. The lower roller 2.2 has two circumferential protrusions 10.1, 10.2, which engage the metal strip 7 at the point at which the inner edge of the regions with less material thickness 12.1, 12.2 is to run, and which produce the first recesses, i.e. regions with reduced material thickness. In FIG. 2 the lower roller 2.2 has two protrusions 10.1, 10.2. It may also be however that only one protrusion is arranged on this roller or a plurality of protrusions are arranged on the roller. The protrusions 10.1, 10.2 are very narrow so that only narrow channels are pressed into the metal strip 7 by the first roller pair 2.1, 2.2. Towards the ends of the roller 2.2 the roller diameter reduces so that the end regions of the roller 2.2 are formed as truncated cones. The roller 2.1 situated on the opposite side of the metal strip 7 has an inner region with a constant diameter. The inner region is somewhat longer than the distance of the protrusions 10.1, 10.2 on the lower roller 2.2. Towards the ends the diameter of the upper roller 2.2 continuously increases so that the roller 2.2 is also formed as a truncated cone in the outer region. Due to the diagonally running edge regions of the upper roller 2.1 and the lower roller 2.2, the edges 9.1, 9.2 of the flat metal strip 7 are bent downwards. Here, the protrusions 10.1, 10.2 situated on the lower roller 2.2 act as counter parts or bending edges and thus facilitate the bending of the edges 9.1, 9.2 downwards. However, provision can also be made to bend the edges upwards.

In FIG. 2 both the upper roller 2.1 and the lower roller 2.2 are illustrated as single components. However, provision can also be made to assemble these rollers from a plurality of single components. For example, provision can be made that the central region of the upper roller consists of a roller component with a constant diameter to which two further roller components are joined, the diameter of which increases from the inside to the edge of the upper roller so that these roller components are essentially formed as truncated cones. The lower roller can also be formed similarly.

Figure 3:
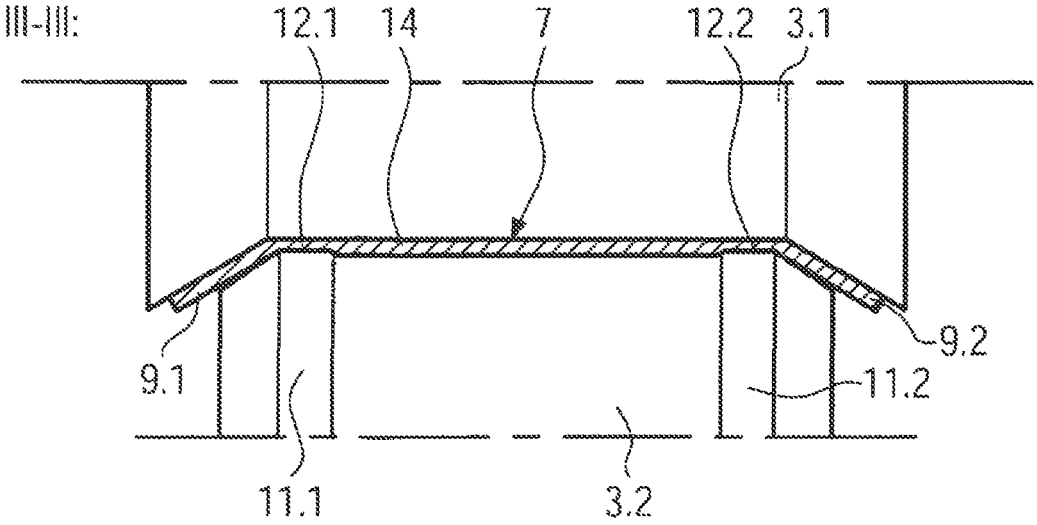

FIG. 3 illustrates a section through another roller pair 3.1, 3.2 along the line III-III in FIG. 1. Here too, the lower roller 3.2 again has circumferential protrusions 11.1, 11.2. The protrusions 11.1, 11.2 however have a greater width than the protrusions 10.1, 10.2 on the lower roller 2.2 of the roller pair 2.1, 2.2 in FIG. 2. The distance of the inner edges of the circumferential protrusions 11.1, 11.2 is identical to the distance of the inner edges of the circumferential protrusions 10.1, 10.2 on the roller 2.2. Further roller pairs, which are not illustrated, are located between the roller pairs 2.1, 2.2 and 3.1, 3.2 in the roll-profiling system 1. The width of the circumferential protrusions on the lower rollers increases on these roller pairs so that the width of the regions with less material thickness 12.1, 12.2 is increased in the roller pairs.

When the metal strip 7 enters the second and all further roller pairs the lower roller first makes contact with the bent-up edges 9.1, 9.2 of the metal strip 7 and presses them against the upper roller before the circumferential protrusions of the lower roller engage the metal strip 7 and widen the recess. When widening the recess, outer edge of the circumferential protrusions of the lower roller first engages in the metal strip 7. The required shaping force is reduced in this way.

The inner edges of the circumferential protrusions on all roller pairs have a constant distance. Thus, the distance of the inner edges of the regions with less material thickness 12.1, 12.2 is also constant. The material forced out of these regions is thus only pushed outwards, so that no collection of material can occur in the central region 14 of the flat metal strip 7. Since the circumferential protrusions always lie on the flat metal strip 7 over the complete width of the regions with less material thickness 12.1, 12.2, formation of channels in these regions with less material thickness is prevented 12.1, 12.2.

As illustrated in FIG. 3, the end regions of the lower roller 3.2 and of the upper roller 3.1 are again formed as truncated cones, wherein the end regions of the upper roller 3.1 are formed such that their diameter increases to the ends of the upper roller 3.1. The end regions of the lower roller 3.2 are formed opposite to this, so that the diameter of the lower roller 3.2 continuously decreases starting from the protrusions 11.1, 11.2 and in each case has the lowest value at the ends of the roller 3.2. The opening angle of these regions of the rollers 3.1 and 3.2 formed as truncated cones can be greater than the opening angle of the regions of the rollers 2.1, 2.2 in FIG. 2 which are formed as truncated cones. The opening angle of the regions formed as truncated cones can increase from roller pair to roller pair until a maximum value of the opening angle is attained. The edge regions 9.1, 9.2 of the flat metal strip 7 are thus bent slightly further downwards in each roller pair until a maximum erection angle is reached. The maximum erection angle corresponds to the maximum opening angle of the regions of the rollers formed as truncated cones. In FIG. 1 the maximum value of the opening angles and therefore also the maximum value of the erection angles has already been attained with roller pair 3.1, 3.2.

Due to this bending of the edge regions 9.1, 9.2 of the flat metal strip 7, the section modulus of the flat metal strip 7 is increased, wherein the tendency to form undulations is reduced. This effect is reinforced in that the width of the regions with less material thickness 12.1, 12.2 of the metal strip 7 is increased incrementally, wherein the displaced material of the flat metal strip 7 is in each case only pushed outwards, i.e. sidewards. Since the bending of the edge regions 9.1, 9.2 of the flat metal strip 7 occurs almost simultaneously with the penetration of the circumferential protrusions of the respective lower roller, a further positive effect arises. Due to the bending of the edges 9.1, 9.2, weakening of the material in the bending radius or the bending edge occurs, the material is stretched and it starts to flow. Consequently, an easy sidewards displacement of the material is possible. Since this combination of bending and pressure occurs in each roller pair, the formation of the regions with less material thickness 12.1, 12.2 over the length of the flat metal strip 7 is facilitated.

Figure 4:
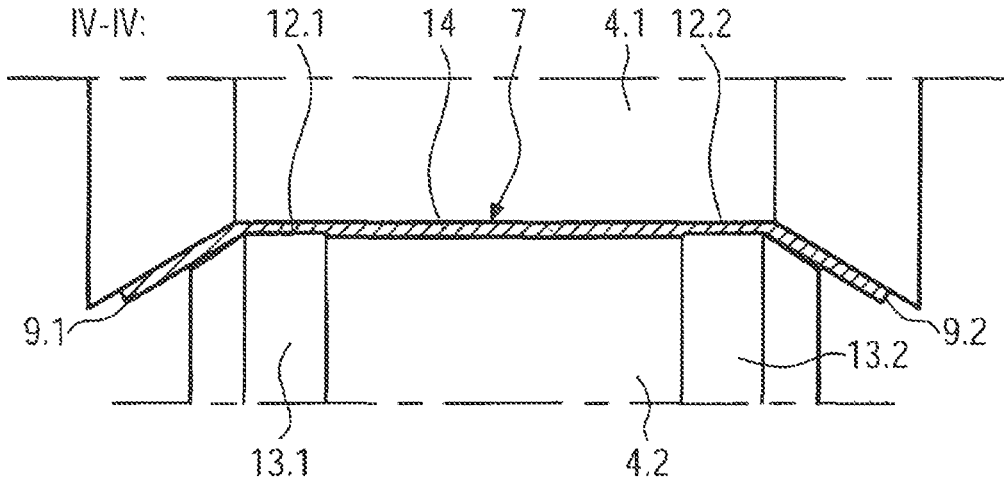

FIG. 4 illustrates a section through a third roller pair 4.1, 4.2 in FIG. 1. Also in FIG. 4 only one half of the upper roller 4.1 and the lower roller 4.2 is shown in each case. The lower roller 4.2 has in turn circumferential protrusions 13.1, 13.2, which again have a greater width than the circumferential protrusions 11.1, 11.2 in the lower roller 3.2 in FIG. 3. The width of the regions with less material thickness 12.1, 12.2, which run in the longitudinal direction of the flat metal strip 7, is also increased still further. Also the lower roller 4.1 and the upper roller 4.2 again have end regions formed as truncated cones, wherein the diameter of the upper roller 4.1 increases towards the ends of the upper roller 4.1 and the lower roller 4.2 is formed opposite to this so that its outer diameter reduces starting from the circumferential protrusions 13.1, 13.2 and running towards the ends. As already described, the opening angle of this truncated cone has attained its maximum value for which good engagement of the lower roller 4.2 into the flat metal strip 7 is still possible. This maximum value lies in a range from 10.degree. to 80.degree. and is preferably 30. During the penetration of the circumferential protrusions 13.1, 13.2 into the flat metal strip 7, the edges 9.1, 9.2 of the flat metal strip 7 are drawn inwards. In the next following roller pair the edges 9.1, 9.2 of the flat metal strip are again bent slightly outwards so that simultaneous bending of the edges and engagement of the circumferential protrusions into the flat metal strip 7 continue to occur in each roller pair. In this way the positive effect described above that the material from the regions with less material thickness 12.1, 12.2 can be easily forced sidewards is achieved also for this roller pair.

Figure 5:
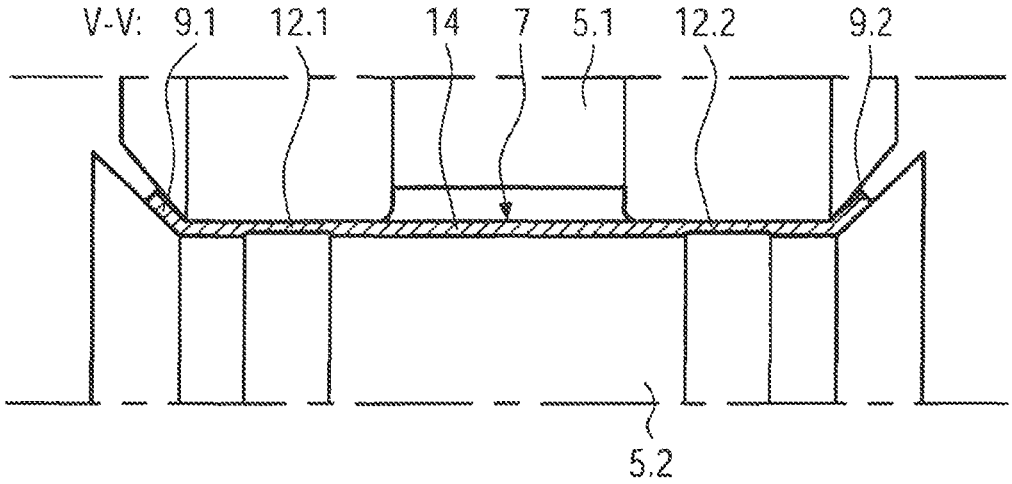

When the regions with less material thickness 12.1, 12.2 of the flat metal strip 7 have reached the desired width, the metal strip 7 is shaped to form a profile. An intermediate step in shaping to form the profile is illustrated in FIG. 5. The edge regions 9.1, 9.2 of the flat metal strip 7 are now bent in the opposite direction. The lower roller 5.2 has a cylindrical central region with a first diameter to which two further cylindrical regions with a slightly larger diameter are joined, which engage the regions with less material thickness 12.1, 12.2 of the metal strip 7 and support them so that these regions are not deformed again. Then at these regions of the lower roller 5.2 a further cylindrical region with less diameter adjoins which corresponds to the first diameter. The ends of the lower roller 5.2 are again formed as truncated cones, wherein the diameter increases outwards so that the edge regions of the flat metal strip 7 are now bent upwards. The upper roller 5.1 is formed complementary to this, i.e. the end regions of the upper roller 5.1 are also formed as truncated cones, wherein the diameter of these truncated cones reduces outwards.

Figure 6:
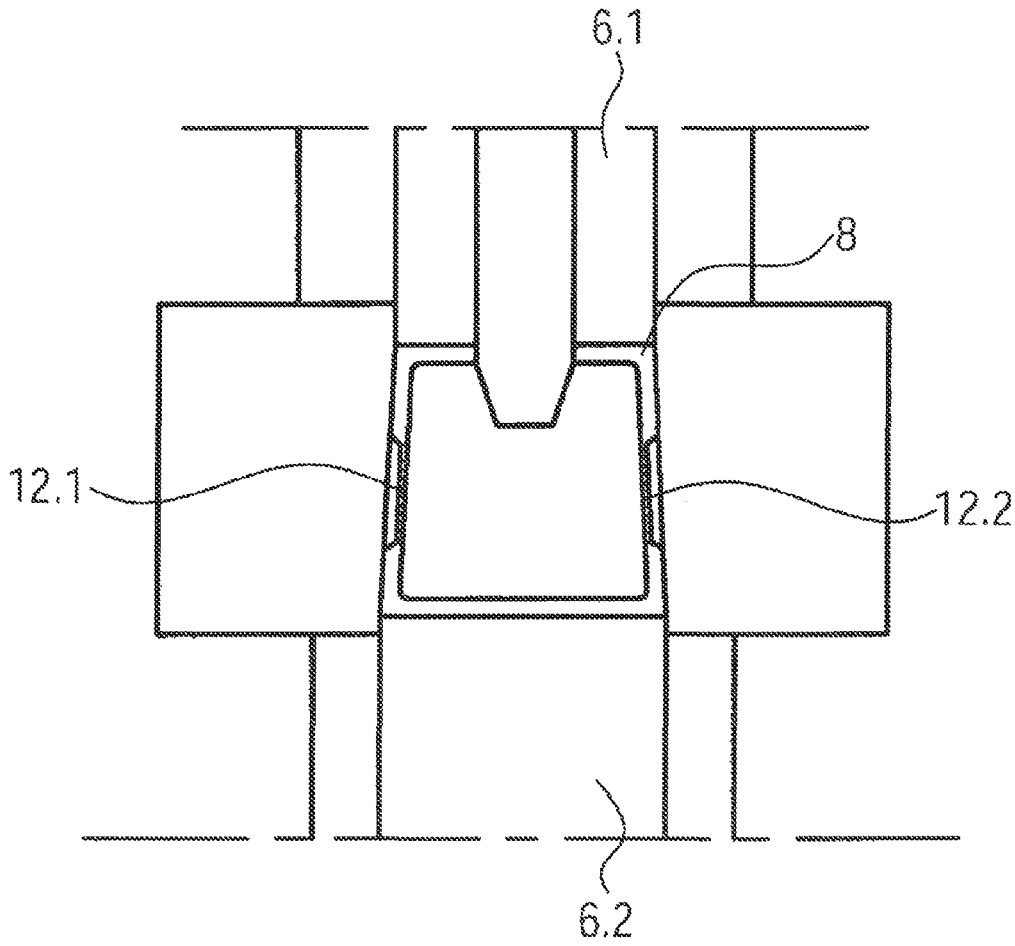

FIG. 6 illustrates one of the last forming steps. The flat metal strip 7 has almost reached the desired profile shape. This profile 8 is for example essentially rectangular, wherein the regions with less material thickness 12.1, 12.2 are arranged on two opposite sides of the profile 8. The profile 8 is not closed. Provision can however also be made to close the profile 8 and optionally weld it by means of a welded seam.

As already mentioned, both the lower roller as well as the upper roller need not be formed as one part in all the roller pairs. Provision can also be made for the rollers to be composed of a plurality of roller components which are arranged adjacently. This is illustrated for example in FIG. 6. Here, side supporting rollers are provided which support the sides of the profile 8.

In the roll-profiling system additional operating stations can be provided for carrying out further production steps, such as for example, punching, stamping or trimming the profile to length.

In the following the manufacturing method for the profile 8 is explained based on FIGS. 1-6.

As illustrated in FIG. 1, flat metal strip 7 is made available on a coil and fed to the roll-profiling system 1. In a first roller pair 2.1, 2.2 of the roll-profiling system 1 the edges 9.1, 9.2 of the metal strip 7 are bent downwards so that a plane running through the central part 14 of the metal strip 7 encloses in each case an erection angle with planes which run through the bent edges 9.1, 9.2.

Meanwhile two circumferential protrusions 10.1, 10.2 arranged on the lower roller 2.2 (refer to FIG. 2) engage the metal strip 7 at the bending edge and each produces a first narrow recess, i.e. a region with less material thickness 12.1, 12.2. In this way, the edges 9.1, 9.2 of the metal strip 7 are pulled still further slightly downwards. As already described, due to the bending a flow of the material of the metal strip 7 is produced at the bending edge such that the sidewards material displacement in the region of the recess is facilitated.

In the following roller pairs of the roll-profiling system 1 the edges 9.1, 9.2 of the metal strip 7 are bent further until the erection angle reaches a maximum value (refer to roller pair 3.1, 3.2). Simultaneously, the width of the circumferential protrusions arranged on the lower rollers increases, wherein the width of the regions with less material thickness 12.1, 12.2 is enlarged. The circumferential protrusions of the lower rollers furthermore engage in the region of the bending edge of the bent edges 9.1, 9.2.

Once the maximum erection angle is reached, as illustrated for example in FIG. 3, then the edges 9.1, 9.2 of the metal strip 7 are pulled still further downwards with each penetration of the circumferential protrusions of the lower roller. Since the maximum erection angle should not be exceeded, the edges 9.1, 9.2 of the metal strip 7 are therefore bent upwards slightly in each further roller pair, for example in the roller pair 4.1, 4.2, before engaging the circumferential protrusions. Also in this way a flow of the material of the metal strip 7 is produced in the region of the bending edge of the edges 9.1, 9.2 and consequently the formation of the regions with less material thickness is facilitated.

Once the regions with less material thickness 12.1, 12.2 have attained the desired width, then the metal strip 7 is shaped to form a profile 8 (refer to FIG. 5). The edges 9.1, 9.2 of the metal strip 7 are bent in the opposite direction, i.e. upwards. Further shaping steps follow until the desired profile 8 has been produced (FIG. 6).

The method preferably involves a continuous process.

The method can additionally comprise further production steps such as punching, stamping or trimming the profiles 8 to length.

As already described, with wide metal strips it is more advantageous not to bend the edges of the metal strip, but instead the regions arranged adjacent to the recess or recesses. In this case the method described above is then implemented on the regions arranged adjacent to the recess or recesses instead of on the edges of the metal strip.

The invention claimed is:

1. Method for the manufacture of a profile with a cross-section of different thicknesses made from a flat metal strip by means of roll-profiling, comprising:

producing, using a first roller pair having an upper roller and a lower roller, a first recess with a reduced material thickness on at least one side of the metal strip, the first recess being produced by a first protrusion arranged on the lower roller; and widening said first recess, using at least one following roller pair, each following roller pair having a following upper roller and a following lower roller, the following lower roller having a following protrusion with an increased protrusion width for increasing the first recess width to form a region with reduced material thickness, wherein a region of the flat metal strip arranged adjacent to the first recess is bent before and/or during an engagement of the first roller pair by obliquely running edge regions of the upper roller and the lower roller, the protrusion arranged on the lower roller serving as a counter part or bending edge, and wherein the bent region of the metal strip is incrementally bent more by each following roller pair until a maximum erection angle between a central part of the metal strip and the bent region is obtained.

2. Method according to claim 1, wherein the lower roller of the first roller pair has a second protrusion for producing a second recess, and wherein an inner region with constant diameter of the upper roller is wider than a distance between the first protrusion and the second protrusion on the lower roller.

3. Method according to claim 1, wherein each of the first roller pair and the at least one following roller pair engages the metal strip in a bending region of the bent region for producing the first recess.

4. Method according to claim 1, wherein the bent region of the metal strip is bent in a direction of the side of the metal strip in which the at least one recess is provided.

5. Method according to claim 1, wherein each lower roller of the at least one following roller pair first engages the bent region of the metal strip and presses the bent region against the corresponding opposing upper roller before the first recess is widened.

6. Method according to claim 1, wherein, after reaching the maximum erection angle, the bent region of the flat metal strip is bent back in a direction of a plane running through the central part of the metal strip before engaging each remaining following roller pair.

7. Method according to claim 1, wherein the maximum erection angle between the bent region of the metal strip and the central part of the metal strip is located in the range from 10° to 80°.

8. Method according to claim 1, wherein both edges of the flat metal strip are bent.

9. Method according to claim 1, wherein a lateral edge of the region with less material thickness, which is arranged closer to a center of the metal strip, maintains a constant position with respect to the center of the metal strip.

10. Method according to claim 1, wherein the method comprises further production steps such as punching or stamping.

11. Method according to claim 1, wherein the maximum erection angle is 30°.

* * * * *

UNITED STATES PATENT AND TRADEMARK OFFICE

CERTIFICATE OF CORRECTION

PATENT NO. : 8,646,303 B2
APPLICATION NO. : 12/739879
DATED : February 11, 2014
INVENTOR(S) : Welser et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 701 days.

Signed and Sealed this
Twenty-ninth Day of September, 2015

Michelle K. Lee

Michelle K. Lee
*Director of the United States Patent and Trademark Office*